US005484195A

United States Patent [19]

O'Donnell

[11] Patent Number: 5,484,195

[45] Date of Patent: Jan. 16, 1996

[54] BEDDING SYSTEM DISPLAY ASSEMBLY

[75] Inventor: Thomas J. O'Donnell, Westlake, Ohio

[73] Assignee: Sealy, Inc., Cleveland, Ohio

[21] Appl. No.: 227,042

[22] Filed: Apr. 13, 1994

[51] Int. Cl.[6] ..... A47F 3/10

[52] U.S. Cl. ..... 312/125; 312/114; 5/609

[58] Field of Search ..... 312/114, 125, 312/249.2, 249.7; 5/607, 609, 133, 475; 211/163, 28; 40/473, 493

[56] References Cited

U.S. PATENT DOCUMENTS

| | | | |
|---|---|---|---|
| 783,961 | 2/1905 | Jennings | 5/133 |
| 2,273,409 | 2/1942 | Livingston | 211/28 |
| 2,348,398 | 5/1944 | Lorey et al. | 211/28 |
| 4,241,964 | 12/1980 | Grubb, Jr. | 312/125 X |
| 5,317,768 | 6/1994 | Klancnik | 5/475 |
| 5,319,814 | 6/1994 | Dyer, Jr. | 5/475 X |

FOREIGN PATENT DOCUMENTS

| | | | |
|---|---|---|---|
| 2210554 | 6/1989 | United Kingdom | 5/607 |

*Primary Examiner*—Kenneth J. Dorner
*Assistant Examiner*—James O. Hansen
*Attorney, Agent, or Firm*—Calfee, Halter & Griswold

[57] ABSTRACT

A display assembly for displaying the interior construction of a bedding system comprises the bedding system to be displayed rotatably mounted on a support pedestal so that the viewer, standing in a single location, can see both sides of the system simply by rotating the system with respect to the pedestal. Portions of the ticking and padding layers covering each of the major surfaces of the bedding system are cut-away so that the viewer can see the interior structure as well as each layer of padding and ticking of the piece, i.e., the mattress or the foundation, being examined. To save space, the bedding system is preferably vertically mounted on the pedestal, and to facilitate better understanding by the viewer, the foundation is preferably arranged so that its mattress-receiving surface faces outwardly rather than towards the mattress as occurs in an actual in-use configuration.

15 Claims, 3 Drawing Sheets

BEDDING SYSTEM DISPLAY ASSEMBLY

BACKGROUND OF THE INVENTION

The present invention relates to a display assembly for use in displaying and advertising the features, particularly the internal construction, of bedding systems such as those composed of innerspring mattresses and foundations, also known as "box springs."

In order to promote the sale of bedding systems at point-of-sale locations, bedding stores typically display a variety of different sample mattress/foundation system and on the sales floor of the store. Also, to educate potential customers about the features of individual bedding systems, advertising literature is normally provided. In addition, some bedding manufacturers also provide "cut-away" displays which illustrate the interior construction of their mattresses and/or foundations. Such cut-away displays typically take the form of a small section of a mattress having some or all of the padding and ticking layers cut away so that the interior construction of the innerspring assembly and one or more of the padding layers can be seen. To keep the display together, a transparent flexible plastic covering layer is also normally provided.

Although such sample mattresses, literature and displays are helpful, they do not provide a full display and illustration of all of the features which make particular bedding systems unique. For example, cut-away sections taken from the interior of mattresses or foundations usually do not include the periphery of the mattress or foundation, which can have a significant impact on the overall performance of the bedding system. In addition, written literature, although capable of illustrating all features, does not do so in a three dimensional way. Therefore, it is oftentimes difficult for the customer to visualize how these features are fully integrated into the bedding system and thereby contribute to its improved performance.

Another factor which is important in connection with point-of-sale sales promotion of bedding systems is floor space. Sample mattresses take up alot of floor space, so that floor space is always at a premium. Therefore, any point-of-sale display system which is intended to be used for advertising or promoting the sale of bedding systems should not be so large that it preempts the display of additional mattresses.

Accordingly, it is an object of the present invention to provide a new display assembly for displaying bedding systems, primarily for use at point-of-sale locations, which is capable of providing a fully integrated, realistic, three-dimensional display of all the unique features of a particular bedding system while at the same time taking up a minimal amount of floor space.

SUMMARY OF THE INVENTION

This and other objects are accomplished by the present invention in accordance with which the bedding system to be displayed is rotatably mounted on a support pedestal so that the viewer, standing in a single location, can see both sides of the system simply by rotating the system with respect to the pedestal. Portions of the ticking and padding layers covering each of the major surfaces of the bedding system are cut-away so that the viewer can see the interior structure as well as each layer of padding and ticking of the piece, i.e., the mattress or the foundation, being examined. To save space, the bedding system is preferably vertically mounted on the pedestal, and to facilitate better understanding by the viewer, the foundation is preferably arranged so that its mattress-receiving surface faces outwardly rather than towards the mattress as occurs in an actual in-use configuration.

By this means, all of the unique design and construction features of a complete bedding system can be displayed in a three-dimensional, fully-integrated fashion by a display system which takes up comparatively little space.

BRIEF DESCRIPTION OF THE DRAWINGS

The present invention is more fully illustrated in the following drawings wherein.

DETAILED DESCRIPTION

Figure 1:
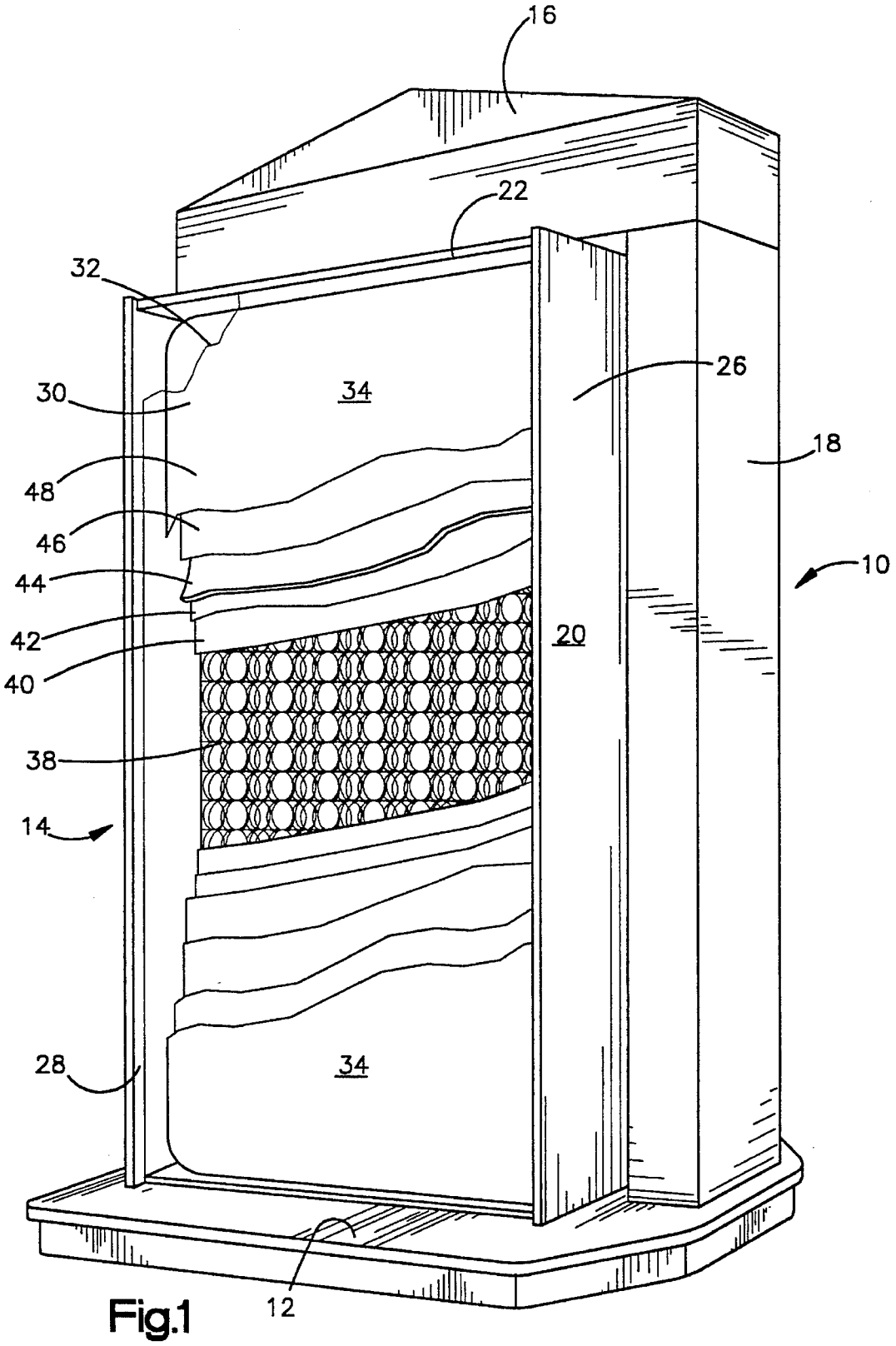
FIG. 1 is an isometric view illustrating the inventive display assembly in a first position with the mattress of the bedding system facing towards the front of the assembly.

As shown in all of the Figures, the inventive display assembly generally indicated at 10 is composed of a pedestal 12 and a bedding system generally indicated at 14. Bedding system 14 is composed of a conventional mattress and a conventional box spring arranged in face-to-face relation with one another, i.e., one on top of the other (although not necessarily touching) with the bedding system so arranged being vertically mounted on the pedestal. In other words, the longitudinal direction of the bed is essentially perpendicular to pedestal 12. In order to secure bedding system 14 in place in this configuration, the top of the bedding system is attached to an arm 16, arm 16 being secured in place by a means of a support member 18 also attached to pedestal 12.

In the embodiment shown, bedding system 14 is contained inside a housing 20. Housing 20 is composed of a top wall 22, a bottom wall 24 and elongated side walls 26 and 28. Also, to keep the bedding assembly in place, transparent protective layers comprising rigid transparent walls 30 connected to the top, bottom and side walls, are provided on both sides of the bedding assembly. For the purposes of illustration only, a portion of rigid transparent wall 30 is shown in FIG. 1 as being broken away at 32.

Figure 2:
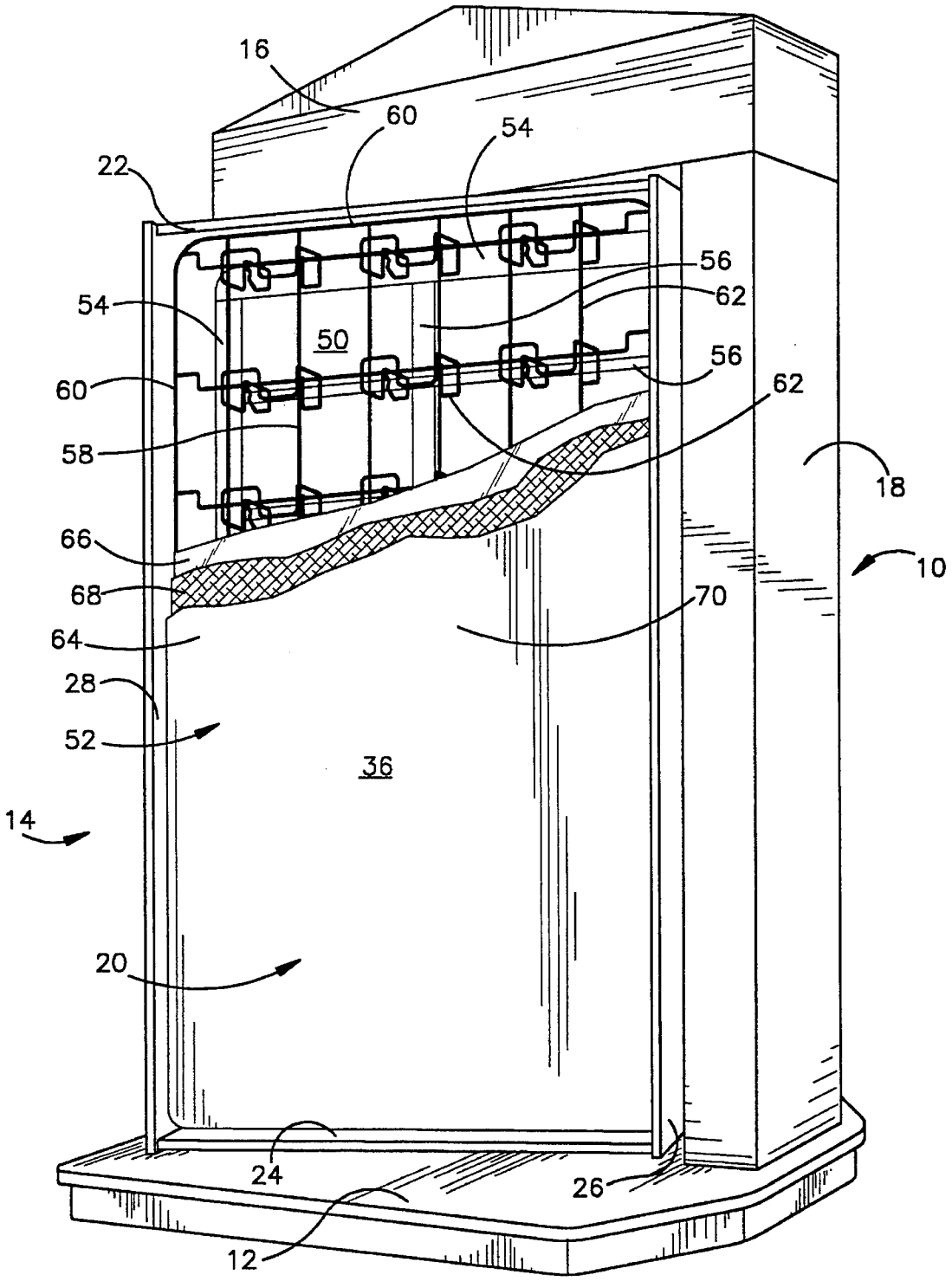
FIG. 2 is a view similar to FIG. 1 with the bedding system being rotated 180° to thereby position the foundation towards the front of the display assembly.
Figure 3:
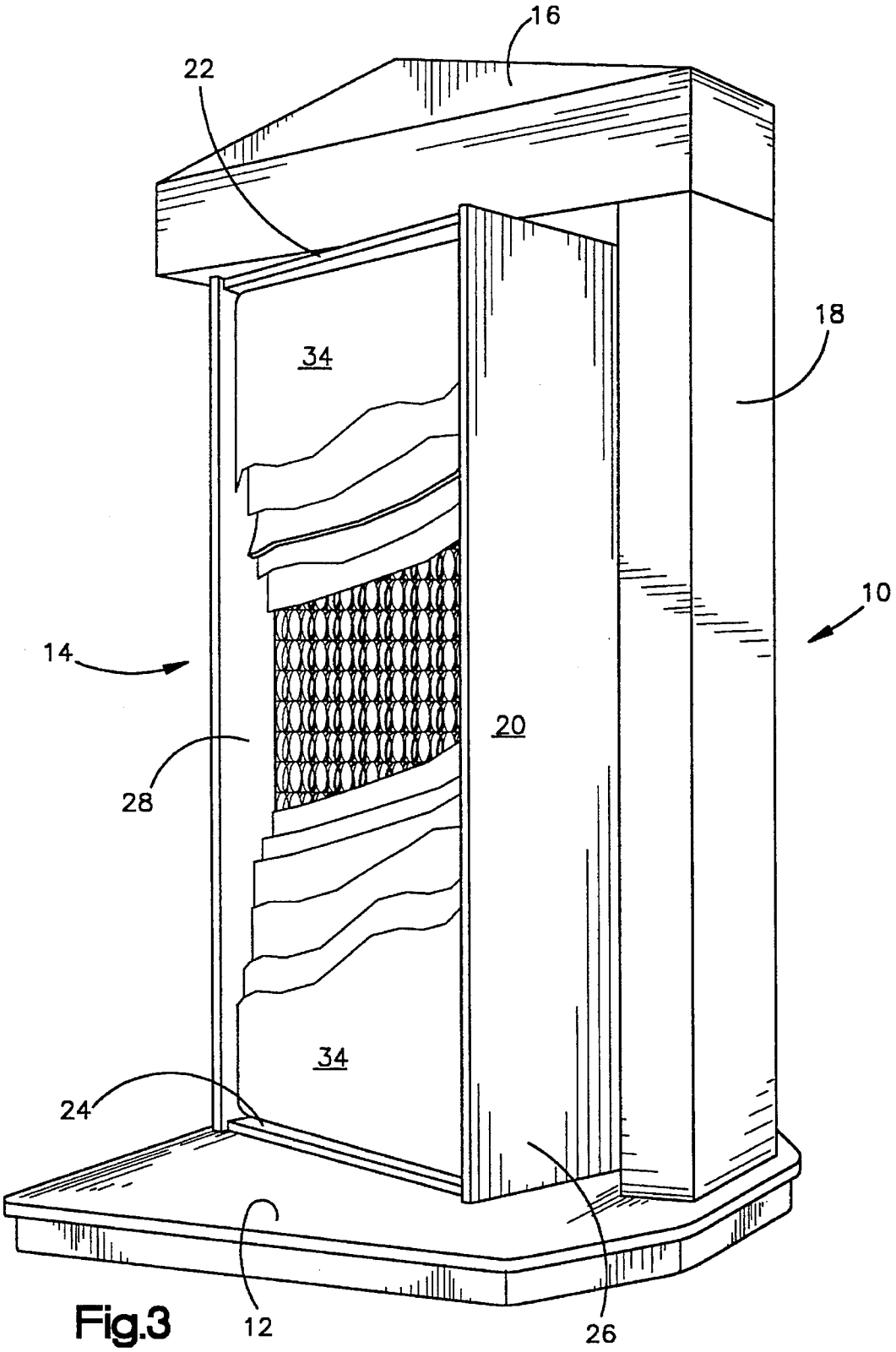
FIG. 3 is still another isometric figure similar to FIGS. 1 and 2 showing the bedding system rotated approximately 45° from the position shown in FIG. 1 to illustrate how the bedding system rotates in accordance with the present invention.

Bedding system 14, inside housing 20, is composed of a mattress generally indicated at 34 (FIGS. 1 and 3) and a foundation 36 (FIG. 2). As appreciated by those skilled in the art, mattresses normally comprise an interior assembly such as an innerspring assembly defining first and second opposed major surfaces, which major surfaces are usually covered by multiple layers of material, typically including at least one padding layer and at least one ticking layer covering the padding layer. Typically, two or more distinct layers of padding material are provided. In the particular embodiment shown, mattress 34 includes an innerspring assembly 38, protective sheathing 40, a fibrous padding layer 42 made from a conventional fibrous padding material, an intermediate foam layer 44 made from a polymer foam such as polyurethane or other suitable material in which the outer surface is provided with a pattern of peaks and valleys, an outer polymer foam layer 46 also made from foam polyurethane or other suitable material (the outside surface of outer layer 46 being essentially flat in configuration) and a ticking layer 48.

As shown in FIG. 1, each of the various padding layers and the ticking layer in mattress 34 have respective portions thereof removed. As a result, when the bedding assembly is arranged in a first position, for example with the mattress facing the front of the assembly so that a viewer facing the front can view the first major surface of the mattress, the interior assembly of the mattress as well as a portion of the individual padding layers in the mattress are open to visual inspection by the viewer. This allows the viewer to see the entire interior construction of the mattress in a fully-integrated three-dimensional display.

Referring to FIG. 2, foundation 36 includes an interior assembly generally indicated at 50 which also defines two opposed major surfaces. As appreciated by those skilled in the art, mattresses are often made with the same construction on both opposing major surfaces so as to be reversible. In contrast, foundations are typically not made in a reversible fashion, the foundations rather having a specific mattress-receiving surface and a specific floor-facing surface.

In the embodiment shown in FIG. 2, foundation 36 is arranged so that the mattress-receiving surface 52 faces outwardly from housing 20. In this configuration, the portion of the foundation defining its floor-facing surface which is normally a layer of ticking (not shown), faces mattress 34 inside housing 20.

To support this ticking layer, interior assembly 50 of the foundation is provided with wooden frame members 54 and steel frame members 56. In addition, to support the mattress in an in-use configuration, interior assembly 50 of the foundation also includes a spring system 58 including terminal spring sections 60 and bearing spring members 62.

Covering terminal spring sections 60 and bearing spring members 62 is a layer of material or "covering" which defines the mattress-receiving surface 52 of the foundation. In the embodiment shown, this covering is composed of a protective sheath 66, a fibrous padding layer 68 and ticking 70. As in the case of mattress 34, the various layers in the mattress-receiving surface 52 of the foundation covering interior assembly 50 of the foundation are partially cut-away so that the internal construction of the foundation, i.e., interior structure 50, as well as the various layers 66 and 68 forming the covering over the foundation interior are open to visual inspection. As in the case of the mattress, this provides a clear, three-dimensional, fully integrated view of the entire internal construction of the foundation when examined by the viewer.

In accordance with the invention, housing 20 is mounted on pedestal 12 and arm 16 so as to be rotatable with respect to the pedestal along the longitudinal axis of the bedding system. In the embodiment shown, this is done by "lazy-susan" type bearings which allow the bedding system to freely rotate through a full 360° of rotation. In other embodiments, an electric motor or other motive means, for example, can be provided to rotate the bedding system upon command of the viewer. In either instance, the entire internal structure of the bedding system, both the mattress and the foundation, is displayed to the viewer in a single location in a totally lifelike, three-dimensional, fully-integrated manner without requiring the viewer to move from that location to see the full display. Thus, the inventive display assembly enables the viewer to reach a thorough and complete understanding of the internal structure of the displayed bedding system in a simple and straightforward manner. Furthermore, because the bedding assembly is vertically oriented, it takes up a comparatively small amount of floor space and therefore can be used in many instances without preempting floor space needed for the display of other products. Also, by providing the inventive display assembly with casters, it can be moved to any convenient location very easily, thereby facilitating efficient reallocation of space during typical sales floor reconfigurations.

Although only a single embodiment of the invention has been illustrated above, many modifications can be made without departing from the spirit and the scope of the invention. For example, although the foregoing embodiment employs only one support member for supporting arm 16, it is readily apparent that two or more support members could be employed. Furthermore, although the foregoing embodiment illustrates the housing and bedding system being rotatable through a full 360° of rotation so that the viewer, standing in the same location, can view the entire interior construction of the bedding systems without moving, it should be appreciated that a full 360° of rotation is unnecessary. Any system which will allow movement between first and second positions illustrating the internals of the mattress and foundation, respectively, regardless if the viewer has to make movements to see these interiors, realizes advantages of the present invention. All such modifications are intended to be included within the scope of the present invention, which is to be limited only by the following claims:

I claim:

1. A display assembly displaying an interior construction of a bedding system, said display assembly comprising a pedestal, and a bedding system to be displayed, said bedding system comprising an innerspring mattress having an innerspring assembly defining first and second major surfaces, at least said first major surface having a padding layer thereon and a ticking layer over said padding layer, and a foundation having an interior assembly defining a mattress-receiving surface and a floor-facing surface opposite said mattress-receiving surface, said mattress-receiving surface having a covering thereon, said mattress and said foundation being arranged so that the second major surface of said mattress faces the floor-facing surface of said foundation, said bedding system being rotatably mounted on said pedestal so that said bedding system can be rotated between a first position in which the first major surface of said mattress is open to visual inspection and a second position in which the mattress-receiving surface of said foundation is open to visual inspection a portion of the ticking layer of said mattress being removed therefrom so that the padding layer thereunder is open to visual inspection when said bedding system is in said first position, a portion of said padding layer also being removed therefrom so that the innerspring assembly of said mattress is also open to visual inspection when said bedding system is in said first position, a portion of the covering on the mattress-receiving surface of said foundation also being removed so that the interior assembly thereof is open to visual inspection when said bedding system is in said second position.

2. The display assembly of claim 1 wherein said bedding system is elongated and defines a longitudinal direction and a transverse direction, said bedding system being mounted on said pedestal to rotate about a longitudinal axis thereof.

3. The display assembly of claim 2 wherein said bedding system defines a bottom and a top, the bottom of said bedding system being rotatably mounted on said pedestal, said assembly further comprising a support arm mounted on said pedestal, the top of said bedding system being rotatably mounted on said support arm.

4. The display assembly of claim 3 further comprising motive means for causing rotation of said bedding system with respect to said pedestal.

5. The display assembly of claim 3 wherein said bedding system is freely rotatable with respect to said pedestal.

6. The display assembly of claim 5 further comprising a first transparent protective layer covering the first major surface of said mattress and a second transparent protective layer covering the mattress-receiving surface of said foundation.

7. The display assembly of claim 6 further comprising a housing, said bedding system being contained in said housing, said housing being rotatably mounted on said pedestal and said arm.

8. The display assembly of claim 7 wherein said housing comprises a top wall rotatably mounted on said arm, a bottom wall rotatably mounted on said pedestal and side walls connecting said top and bottom walls.

9. The display assembly of claim 8 wherein said transparent protective layers comprise rigid transparent walls connected to at least one of said top, bottom and side walls for enclosing said bedding assembly in said housing.

10. The display assembly of claim 9 wherein the padding layer of said mattress comprises at least two distinct layers of padding material arranged one on top of the other, portions of each layer of padding material being removed so that a portion of each padding layer and the innerspring assembly of said mattress are open to visual inspection when said mattress is in said first position.

11. The display assembly of claim 1 wherein the padding layer of said mattress comprises at least two distinct layers of padding material arranged one on top of the other, portions of each layer of padding material being removed so that a portion of each padding layer and the innerspring assembly of said mattress are open to visual inspection when said mattress is in said first position.

12. The display assembly of claim 1 further comprising a first transparent protective layer covering the first major surface of said mattress and a second transparent protective layer covering the mattress-receiving surface of said foundation.

13. The display assembly of claim 1 further comprising a housing, said bedding system being contained in said housing, said housing being rotatably mounted on said pedestal.

14. The display assembly of claim 13 wherein said housing includes a pair of rigid transparent walls, one of said rigid transparent walls covering the first major surface of said mattress and the other of said rigid transparent walls covering the mattress-receiving surface of said foundation.

15. A display assembly displaying an interior construction of a bedding system, said display assembly comprising a pedestal and a bedding system to be displayed, said bedding system comprising a mattress and a foundation, each of said mattress and foundation having a respective interior assembly defining two opposed major surfaces and at least one layer of material covering each of said major surfaces, said mattress and foundation being arranged in facing relation so that said bedding system defines two outer major surfaces open to visual inspection, a portion of the layers of material covering both outer major surfaces being cut away so that the interior assembly of said mattress and interior assembly of said foundation are open to visual inspection, said bedding system being rotatably mounted on said pedestal so that the interior assembly of said mattress and the interior assembly of said foundation can be viewed from the same location by rotation of said bedding assembly with respect to said pedestal.

* * * * *